United States Patent [19]

Atkins et al.

[11] 3,968,962

[45] July 13, 1976

[54] CHILD'S TEETER TOTTER

[76] Inventors: Luther C. Atkins; Jimmy G. Atkins; Vonniebelle Atkins, all of 5207 N. Villa No. 7, Clovis, Calif. 93612

[22] Filed: May 15, 1975

[21] Appl. No.: 577,677

[52] U.S. Cl. ..... 272/55

[51] Int. Cl.[2] ..... A63G 11/00

[58] Field of Search ..... 272/55, 52, 54; D34/5 B, 15 AE

[56] References Cited

UNITED STATES PATENTS

| | | | |
|---|---|---|---|
| 775,133 | 11/1904 | Gaines | 272/55 |
| 1,060,590 | 5/1913 | Donnenwerth | 272/55 |
| 1,461,631 | 7/1923 | Smerechanski | 272/54 |
| 1,527,015 | 2/1925 | Sedlacek | 272/55 |
| 1,576,851 | 3/1926 | Sedlacek | 272/55 |
| 1,580,508 | 4/1926 | Liles | 272/55 |
| 1,586,899 | 6/1926 | Herring | 272/55 |
| 1,731,621 | 10/1929 | Giese | 272/55 |
| 2,978,245 | 4/1961 | Rempel | 272/52 |
| 3,078,092 | 2/1963 | Mills | 272/55 |
| D141,528 | 6/1945 | Ritter | D34/5 B |

FOREIGN PATENTS OR APPLICATIONS

| | | | |
|---|---|---|---|
| 697,494 | 9/1953 | United Kingdom | 272/55 |

*Primary Examiner*—Richard C. Pinkham
*Assistant Examiner*—Arnold W. Kramer
*Attorney, Agent, or Firm*—Blair & Brown

[57] ABSTRACT

A child's Teeter Totter in which a seat is pivotally mounted in a frame and is supported by springs extending downwardly from an upstanding portion of the frame. The springs can be attached at adjusted positions to the seat for supporting children of different weights. A child using the Teeter Totter occupies the seat and grasps a handle projecting upwardly thereon and bounces the seat about its pivot by forcing his feet against the floor.

5 Claims, 4 Drawing Figures

FIG. 1.
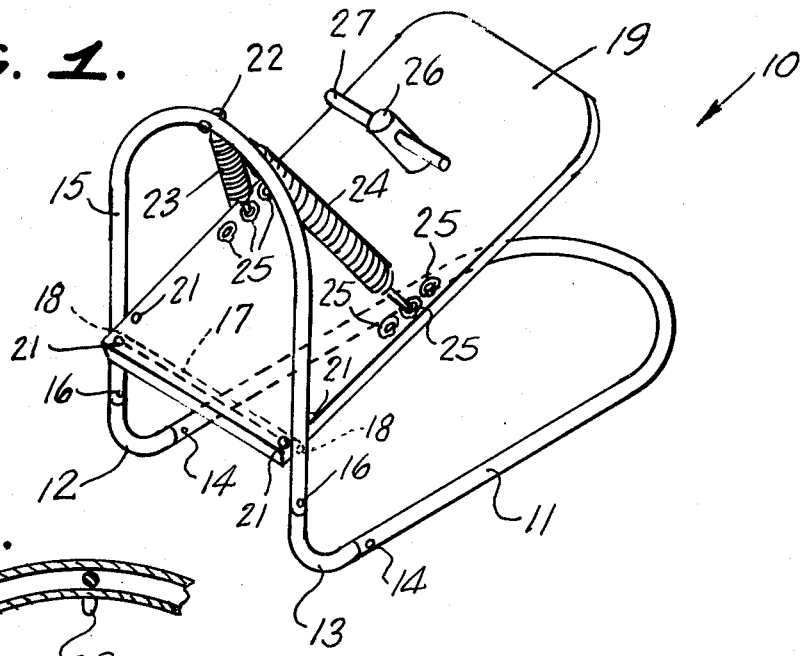
FIG. 4.
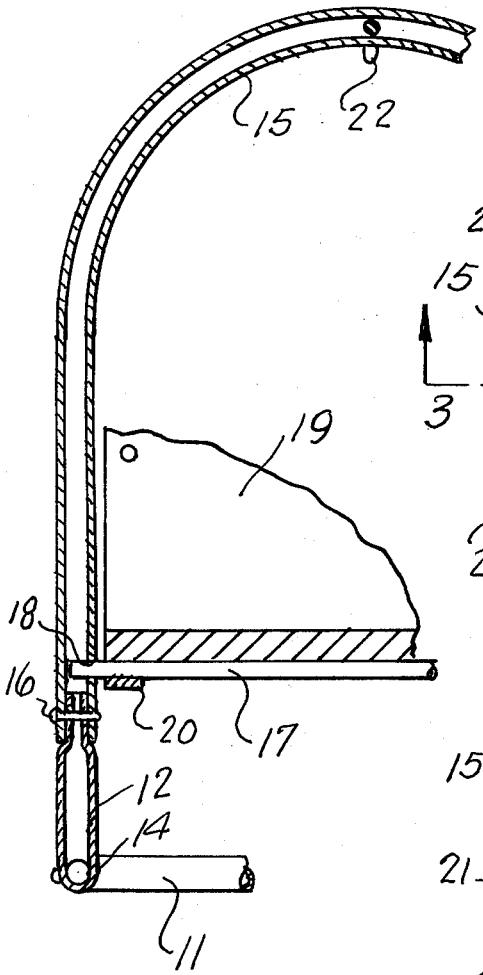
FIG. 2.
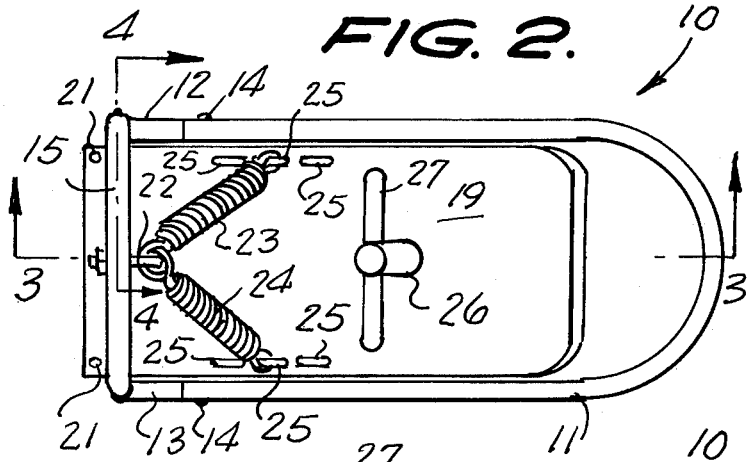
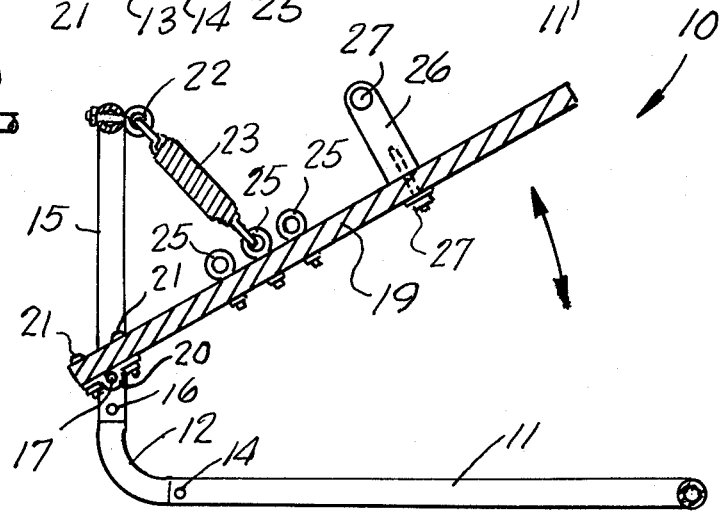
FIG. 3.

CHILD'S TEETER TOTTER

BACKGROUND OF THE INVENTION

1. Field of the Invention

The present invention relates to a child's Teeter Totter bouncing toy.

2. Summary of the Invention

The child's Teeter Totter of the present invention includes a generally U-shaped base frame member rigidly connected to an upright inverted generally U-shaped frame member and having a seat board pivotally supported at one end in the upright frame member. Springs extend from the upper portion of the upright frame member to adjustably selected attaching positions on the seat board for varying the weight capacity of the Teeter Totter for children of varying weights.

The primary object of the invention is to provide a Teeter Totter for the amusement of children.

Other objects and advantages will become apparent in the following specification when considered in light of the attached drawings.

BRIEF DESCRIPTION OF THE DRAWINGS

FIG. 1 is a perspective view of the invention;

FIG. 2 is a top plan view of the invention;

FIG. 3 is a vertical sectional view taken along the line 3—3 of FIG. 2 looking in the direction of the arrows; and FIG. 4 is an enlarged fragmentary transverse sectional view taken along the line 4—4 of FIG. 2 looking in the direction of the arrows.

BRIEF DESCRIPTION OF THE PREFERRED EMBODIMENT

Referring now to the drawings in detail wherein like reference characters indicate like parts throughout the several figures reference numeral 10 indicates generally a child's teeter totter constructed in accordance with the invention.

The teeter totter 10 includes a generally U-shaped tubular base frame member 11 having a pair of elbow members 12 13 connected thereto by means of fasteners 14.

An inverted generally U-shaped upright tubular frame member 15 extends perpendicularly upwardly from the frame member 11 and is secured to the elbow members 12 13 by fastening elements 16.

A shaft 17 extends horizontally across the upright frame member 15 at the lower portion thereof and is seated in bores 18 at each end thereof so as to pivotally mount the shaft 17 in the upright frame member 15. A generally rectangular seat board 19 has one end thereof secured to the shaft 17 by a pair of brackets 20 which encompass the shaft 17 and are secured to the seat board 19 by bolts 21 extending through the seat board 19.

An eye-bolt 22 extends through the center of the upright frame member 15 at its upper most point and has a pair of springs 23 24 secured thereto and extending downwardly and outwardly therefrom. A plurality of spaced-apart eye-bolts 25 are secured along the side edges of the seat board 19 to receive the lower ends of the springs 23 24 in an adjusted position therealong.

A post 26 is mounted centrally of the seat board 19 adjacent one end thereof and is secured thereto by a bolt 27 extending through the seat board 19. A handle 27 extends transversely of the upper end of the post 26 to be grasped by the child using the teeter totter 10.

In the use and operation of the invention the child sits on the seat board 19 at the end thereof opposite the shaft 17 grasping the handles 27 and with his feet in engagement with the floor in order to bounce the teeter totter on the springs 23 24 as desired. The springs 23 24 are adjusted to a selected pair of the eye-bolts 25 in order that children of varying weights may use the teeter totter with equal facility.

Having thus described the preferred embodiment of the invention it should be understood that numerous structural modifications and adaptations may be resorted to without departing from the spirit of the invention.

What is claimed is:

1. A child's teeter totter comprising a generally U-shaped tubular base frame, an inverted generally U-shaped upright frame extending perpendicularly upwardly from said base frame, means connecting the open ends of said U-shaped frames at their juncture, a generally rectangular seat board, means mounting one end of said board in the lower end of said upright frame for pivotal movement about a horizontal axis, a pair of springs connected at one end to the upper end portion of said upright frame, and means selectively adjustably connecting the lower ends of said springs to opposite sides of the upper surface of said seat board.

2. A device as claimed in claim 1 wherein said means connecting said base frame and said upright frame comprise a pair of elbows rigidly connected to the ends of said frames.

3. A device as claimed in claim 2 including a post rigidly connected at one end to said seat board and a handle extending transversely through said post.

4. A device as claimed in claim 3 including an eyebolt at said upper end portion of said upright frame member to which said springs are attached and a plurality of eye-bolts along said opposite sides of said seat board for securing the lower ends of said springs.

5. A device as claimed in claim 4 wherein said means pivotally mounting said seat board to said upright frame includes a shaft secured to one end of said seat board and pivotally mounted in bores in said upright frame member.

* * * * *